United States Patent [19]

Beaudoux et al.

[11] Patent Number: 4,478,254

[45] Date of Patent: Oct. 23, 1984

[54] DEVICE FOR ACTUATING SHEDDING MOTION SEARCHING AND SLOW SPEED OPERATION ON A LOOM

[75] Inventors: Michel Beaudoux, Didenheim; Jean-Pierre Vuillet, Mulhouse, both of France

[73] Assignee: Societe Alsacienne De Constructions Mecanniques De Mulhouse, Mulhouse, France

[21] Appl. No.: 335,254

[22] Filed: Dec. 28, 1981

[51] Int. Cl.[3] ..... D03D 51/08

[52] U.S. Cl. ..... 139/1 E; 139/66 R; 139/336; 403/358

[58] Field of Search ..... 139/1 E, 1 R, 66 R, 139/336; 192/0.098; 403/356, 358, 1

[56] References Cited

U.S. PATENT DOCUMENTS

| | | | |
|---|---|---|---|
| 1,137,256 | 4/1915 | Chamberlin | 403/358 |
| 3,661,185 | 5/1972 | Fumat . | |

FOREIGN PATENT DOCUMENTS

| | | | |
|---|---|---|---|
| 1805939 | 12/1969 | Fed. Rep. of Germany . | |
| 2155636 | 3/1973 | Fed. Rep. of Germany | 139/1 E |
| 2514248 | 9/1976 | Fed. Rep. of Germany | 139/1 E |
| 2935507 | 3/1981 | Fed. Rep. of Germany | 139/1 E |
| 386174 | 1/1933 | United Kingdom | 139/1 E |
| 598983 | 2/1978 | U.S.S.R. | 139/1 E |

*Primary Examiner*—James Kee Chi

*Attorney, Agent, or Firm*—Holman & Stern

[57] ABSTRACT

The invention relates to the textile industry and more particularly to looms. The device comprises a motor-reducing gear unit which can drive the dobby mechanism selectively, through a clutch, this mechanism being normally driven, from the main shaft of the loom by a pulley. A keying system enables the pulley to be made fast to or released from the shaft. The unit can, either drive the dobby mechanism alone for shedding motion searching, or drive the loom and the dobby mechanism for the slow speed operation of the loom. The invention overcomes the drawbacks of pulsed slow speed operation.

6 Claims, 4 Drawing Figures

1
2
3
3'
4
5
6
6'
6''
7
8
10
11
12
13
14
15
16
17
18
19
20
22
24
3A
3B
IA

DEVICE FOR ACTUATING SHEDDING MOTION SEARCHING AND SLOW SPEED OPERATION ON A LOOM

BACKGROUND OF THE INVENTION

1. Field of the Invention

The invention relates to the textile industry and more particularly to weaving. More especially it relates to a device for controlling shedding motion searching and slow speed operation on a loom.

2. Description of the Prior Art

In any loom, when a weft thread breaks in the course of its introduction, the weft-stop mechanism stops the loom and the operator withdraws the broken thread before starting up again. To enable access to the broken weft thread, the dobby mechanism must be rotated slowly backwards in order to open the shed warps and release the thread to be withdrawn. In the case of the manufacture of a fancy cloth including threads of different colors and/or types, the latter are inserted according to a predetermined program. After reversing to enable the broken weft thread to be released, the dobby mechanism must be operated forwards in order to recommence on the thread which, according to the program, must be introduced into the shed.

On the other hand, to proceed with certain adjustments, it is desirable to operate the machine at slow speed.

Customarily, shedding motion searching and slow speed operation constitute two separate operations. The first is done by unfastening the dobby mechanism from the loom and slowly rotating the former by means of a motor-reducing gear unit of low power and the second by supplying pulses to the principal motor driving the loom.

This method of operation, mainly as regards the running of the loom at slow speed is not at all satisfactory: it is extremely noisy, gives serious jolts to the whole of the machine and does not have exactly the characteristics of continuous operation for the observation of a given phase of the weaving process.

It is an object of the present invention to overcome the aforesaid drawbacks.

GENERAL DESCRIPTION OF THE INVENTION

According to the invention there is provided a device for actuating both the shedding motion searching and the slow speed operation on a loom, characterized in that a motor-reducing gear unit can drive either the dobby mechanism alone for shedding motion searching, or the loom and the dobby mechanism for slow speed operation.

BRIEF DESCRIPTION OF THE DRAWINGS

The accompanying drawings as well as the description which follows of a preferred embodiment of a device according to the invention will enable the invention to be better understood, although it is of course not to be taken as limiting the scope of the invention.

DESCRIPTION OF A PREFERRED EMBODIMENT

Figures 1, 4:
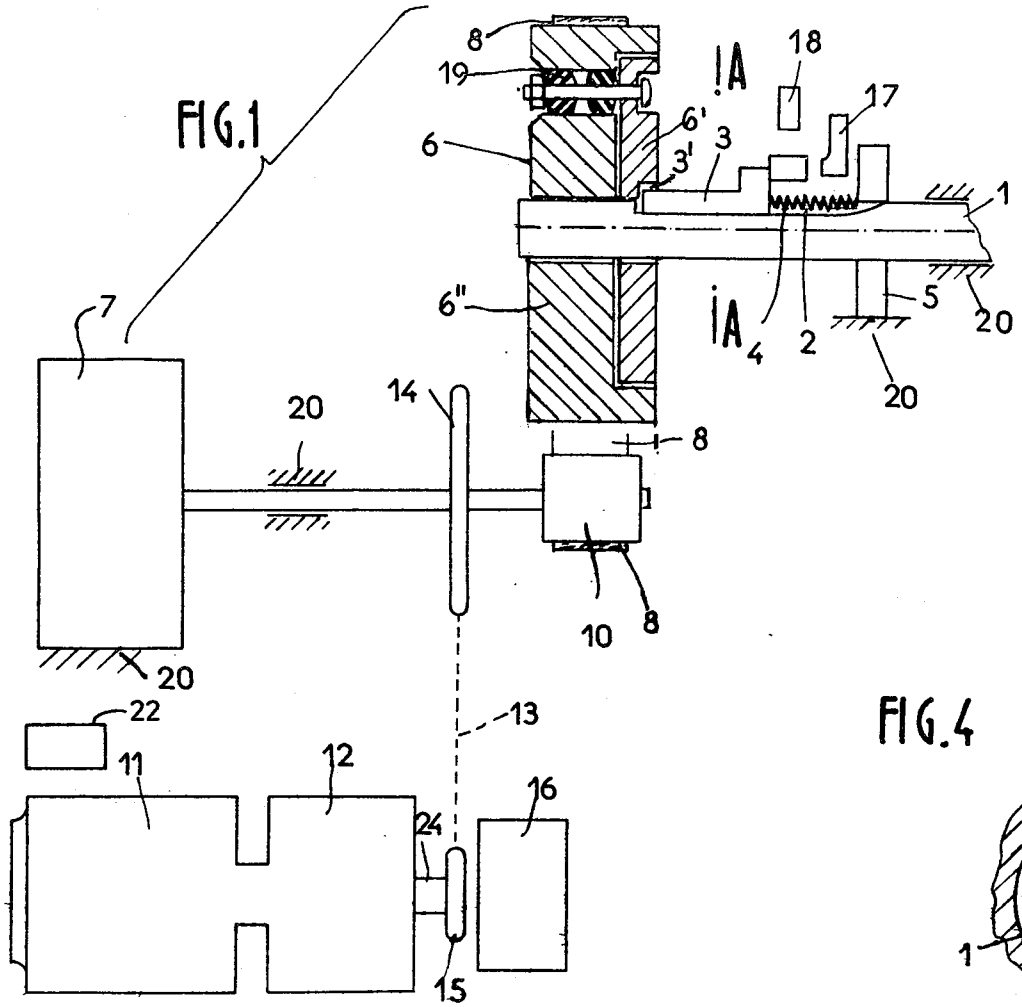
FIG. 1 is a diagrammatic part cross-sectional view of the whole of an embodiment of a device according to the invention.
FIG. 4 is a cross-sectional view taken along the line AA of FIG. 1.

In FIG. 1 the main shaft 1 of a loom can be distinguished; it is supported in rotation with respect to the frame 20 of the machine. It has at one end a longitudinal keyway 2 in which slides a system of keys 3 urged by springs 4 whose other ends are attached to a stop 5 fixed to the shaft 1.

On the shaft 1 is rotatably mounted a pulley 6 which can be made fast for rotation with the shaft 1 by means of the system of keys 3. In the preferred embodiment shown in FIG. 1, the pulley 6 is composed of two concentric parts 6′ and 6″ mounted rotatably on the shaft 1. The part 6′ is hollowed out by a key slot 3′ to receive the key 3. The part 6″ is connected to the part 6′ by silent blocks 19. When the displaceable key 3 enters key slot 3′, it fastens the part 6′ of the pulley 6 to the shaft 1 which rotates it and the motion is transmitted to the part 6″ by the silent blocks or resilient clamping member 19, which bestows a certain elasticity on the entire assembly.

The dobby mechanism box 7, whose input shaft bears a pulley 10, is driven, from the shaft 1, through a belt 8 which passes over the outer part 6″ of the pulley 6 and over the pulley 10.

The dobby mechanism box 7 is also connected to a motor-reducing gear unit, including a motor 11 and a reducing gear 12, for example, by a chain 13 engaged over two chain wheels 14, 15. A clutch system 16 enables the wheel 15 to be made fast or released with respect to the shaft 24 of the reducing gear.

The operation of the device is as follows:

When the loom is operating at normal speed, the main shaft 1 of the machine is fastened to the pulley 6 by key 3 which is normally held in place by its spring 4. The motor-reducing gear 11, 12 is isolated by means of the clutch 16. The principal motor (not shown) hence actuates both the machine and the dobby mechanism 7.

In the case of breakage of a weft thread in the course of insertion, the machine is stopped by the weft-stop mechanism. The operator engages the motor 11 and starts it up. At the same time an electromagnet 17 is energized and it withdraws the key 3 from key slot 3′ in the part 6′ of the pulley 6. The latter starts to rotate and the electromagnet is immediately deenergized. The released keys rub over a track of the pulley 6. The dobby mechanism alone is actuated by the motor 11 through the reducing gear 12. When the pulley 6 has made one revolution, the key 3 enters key slot 3′ and a detector 18 sensitive to the position of the key actuates the cut-off of the power supply to the motor 11. The pulley 6 slows down, then stops. The silent blocks 19 provided in the pulley 6 to give a certain elasticity to the whole facilitate the introduction of the key 3 into key slot 3′.

Figures 2, 3:
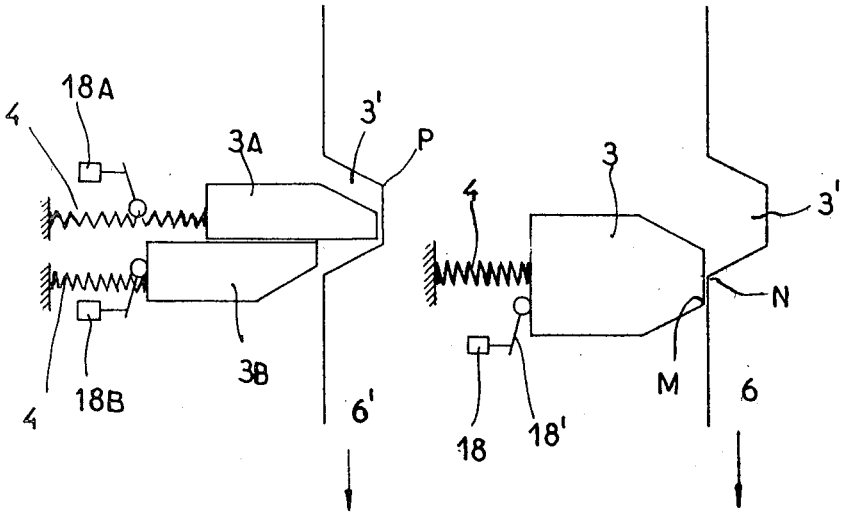
FIGS. 2 and 3 are diagrammatic views showing two embodiments of a portion of a device according to the invention.

FIG. 2 shows a simple embodiment in which the keying system includes only a single key 3. This key enters key slot 3′ when the part N of the latter arrives opposite the point M of the key. However the pulley 6 rotates relatively fast (of the order of 20 rpm) and therefore the impact of the key 3 against the walls of the key slot may sometimes be sufficient to cause it to escape again in spite of the thrust exerted by the spring 4. In this case, the motor is not stopped since the stop control 18, sensitive to the position of the key 3, has insufficient time to come into play. This control may be, for example, a microcontact whose lever 18' must be brought into the position corresponding to the key 3 inserted in key slot 3' to cut off power supply to the motor 11.

The embodiment shown in FIGS. 3 and 4 is more advantageous. In this case, the key is 3 split to form a double key whereby, two key elements 3A, 3B, are contiguous and each is urged by its own spring 4. In the position shown, the key 3A is in position and the microcontact 18A has stopped the motor 11. The pulley 6 hence rotates less rapidly and the key 3B is positioned gently beside 3A when the point P of the key slot will have reached by the engaging end of key element 34.

If the shedding motion searching still necessitates a revolution of the pulley 6, the operator reengages the supply of the motor 11 and the cycle recommences. The motor 11 can drive the pulley 6 in rotation in both directions in order to relocate in all cases the exact weft thread to be inserted in place of that which has just been withdrawn.

In the case, shown in FIGS. 2 and 3, where a keying system with two keys 3A and 3B is used, it is advantageous to associate a position detector, that is to say a microcontact 18A and 18B, individually with each of the keys 3A - 3B. The second microcontact can prevent the engagement of the main motor as long as the second key is not in position in its housing. On the other hand, since the pulley 6 can rotate in both directions, the first key which falls into its housing, interrupts the power supply to the motor 11. To actuate the loom at slow speed, the main motor is stopped and a safety locking device 22 of any known type prevents its reenergization, as long as the clutch system 16 is engaged. The motor 11 is energized and the motor-reducing gear unit 12 engaged and drives both the dobby mechanism 7 and the loom at a speed of the order of 20 rpm with a continuous motion which eliminates all the drawbacks of pulsed operation.

We claim:

1. In a loom having a main shaft adapted to be rotatably driven, a dobby, and first connecting means for operatively connecting said main shaft to said dobby, the improvement for controlling both shedding motion searching and slow speed operation wherein: said first connecting means comprises a pulley rotatably mounted on said main shaft; a key slot in one face of said pulley; a keyway in said shaft positioned to register with said key slot; at least one key slidably arranged in said keyway to releasably engage in said key slot to interlock said pulley with said shaft; resilient means adapted to urge said key into engagement in said key slot; means adapted to disengage said key from said key slot; an auxiliary gear-motor; second connecting means operatively connecting said gear-motor to said dobby; clutch means operatively associated with said second connecting means to connect said gear-motor to said dobby; detector means operatively associated with said key and said gear-motor to detect the position of said key with respect to said key slot and to control said gear-motor in response thereto; so that said gear-motor drives said dobby alone when said key is disengaged from said key slot and drives said dobby and loom together in unison at slow speed when both said key and clutch means are respectively engaged and said main shaft is not driven.

2. The improvement as claimed in claim 1 wherein said pulley comprises two substantially concentric members connected together by resilient damping means, said key slot being in one of said concentric members.

3. The improvement as claimed in claim 1 wherein said means to disengage said key from said key slot comprises an electromagnet.

4. The improvement as claimed in claim 1 wherein said at least one key comprises two keys independently operable in said keyway, and independent resilient means and detector means are provided for each key.

5. The improvement as claimed in claim 1 wherein said detector means deenergizes said gear-motor when said key is engaged in said key slot.

6. The improvement as claimed in claim 1 and further comprising a safety lock means adapted to prevent driving of the main shaft when said gear-motor is engaged.

* * * * *